US006219987B1

(12) United States Patent
Trent et al.

(10) Patent No.: US 6,219,987 B1
(45) Date of Patent: Apr. 24, 2001

(54) ENDCAPS FOR FIBERGLASS RUNNING BOARDS

(75) Inventors: Robert S. Trent, Crown Point, IN (US); R. Michael Manley, Richmond, TX (US)

(73) Assignee: Holland Company, Crete, IL (US)

( * ) Notice: Subject to any disclaimer, the term of this patent is extended or adjusted under 35 U.S.C. 154(b) by 0 days.

(21) Appl. No.: 09/320,035

(22) Filed: May 26, 1999

Related U.S. Application Data

(60) Provisional application No. 60/086,956, filed on May 26, 1998.

(51) Int. Cl.[7] ..... E04C 2/38

(52) U.S. Cl. ..... 52/716.1; 52/676; 52/717.05; 52/802.11

(58) Field of Search ..... 52/41, 177, 660, 52/676, 716.1, 716.8, 717.05, 800.1, 802.1, 802.11

(56) References Cited

U.S. PATENT DOCUMENTS

D. 115,247 * 6/1939 Bonnell ..... 52/716.1 X
4,249,273 * 2/1981 Jakowicki ..... 52/169.7 X
4,769,966 * 9/1988 Petri ..... 52/716.8
4,971,849 * 11/1990 Azzar ..... 52/717.05 X
5,653,075 * 8/1997 Williamson ..... 52/802.1 X

OTHER PUBLICATIONS

United States Gypsum, Brochure, 1980, 3 pages, "General Purpose Repair Running Boards Kits, Net Prices and Specifications G–668, Effective Date Apr. 1, 1980".

GS Metal Corp., Brochure, 4 pages, TPD–129/rev. 7–88, "Grip Strut, End Platforms and Brake Steps, AAR–approve".

* cited by examiner

*Primary Examiner*—Carl D. Friedman
*Assistant Examiner*—Kevin D. Wilkens
(74) *Attorney, Agent, or Firm*—Lee, Mann, Smith, McWilliams, Sweeney & Ohlson

(57) ABSTRACT

An arrangement of endcaps particularly formed and arranged for use in connection with composite deck beams particularly adapted to use on rail car running boards but is also suitable to other beam type decks such as those used on semi-trailers, in marine applications or as industrial catwalks. The endcaps close the ends of fiberglass reinforced plastic running boards, complementing the strength, economy and durability of such materials.

12 Claims, 3 Drawing Sheets

ENDCAPS FOR FIBERGLASS RUNNING BOARDS

CLAIM OF PRIORITY

This application claims priority based on provisional application Ser. No. 60/086,956 filed May 26, 1998.

BACKGROUND OF THE INVENTION

1.Field of the Invention

The invention is an integrally formed endcap for use in connection with composite deck beams, such as fiberglass beams. Such beams are typically arranged in parallel fashion to form a platform deck or running board of a vehicle, railcar, semi-trailer, marine vessel, or the like. These running boards typically provide a platform for an individual to stand upon while boarding or exiting such a vehicle, or during operation of the vehicle. Running boards of this type are commonly used in the railcar industry. The beams can also provide a platform for use as an industrial catwalk or any other platform application. The endcaps provide a closure for the edges of the running board formed by the terminal ends of the beams, thereby protecting the beam ends from damage and covering the exposed beam ends of the edge of the running board. In the railroad industry, the closed edge reduces risks of clothing or limbs of a railroad worker catching exposed beam ends.

2. Description of Related Art

Metal running boards and platform decks are well known in the art. Typically, endcaps for metal running boards are fastened in a variety of ways, such as by welding, bolting or riveting. Metal running boards are used primarily for their strong resistance to adverse effects caused by harsh environmental conditions. Fiberglass running boards are also known in the art as an alternative to metal running boards. Fiberglass is a relatively strong material and provides an alternative to metal. Fiberglass running boards take advantage of the properties of fiber reinforced plastic, such as the strength, economy and durability of such materials. The use of fiberglass also facilitates the use of adhesive bonding construction in lieu of weld bonding or the use of mechanical fasteners. Because fiberglass is a composite material, exposed ends of fiberglass beams have fiber ends embedded in the plastic matrix. While exterior fiberglass surfaces, when adequately coated by a gelcoat or paint, resist UV deterioration, the cured resin that bonds the glass fibers together is very prone to rapid deterioration if unprotected from UV exposure. The cured resin of fiberglass beams may be exposed at deck beam ends, especially when the deck beams have been cut. Ends of beams constructed from fiberglass rails can also form undesirable splinters and cracks when exposed to various environmental conditions or physical forces. These properties for fiberglass running boards are particularly evident in the method of manufacture known as pultrusion, whereby continuous lengths are formed through a die and cut to length. Therefore, the use of fiberglass running boards is limited by their propensity for such damage. Close tolerance adhesively bonded endcaps for fiberglass beams of a running board are not known in the prior art.

It is therefore an object of the present invention to provide an integral endcap unit that connects to a plurality of beam ends of a running board.

It is also an object of the present invention to provide a running board endcap unit that can be used with fiberglass running boards to prevent splintering or cracking of the fiberglass beams of the running board.

It is also an object of the present invention to provide a running board endcap unit having a close tolerance fit to the beams of a running board to allow the endcap unit to be bonded to the ends of the running board beams instead of welded, riveted, or bolted to the beams.

It is also an object of the present invention to provide an integral endcap unit having recesses at its ends to compliment adjacently connected endcap units connected to a running board having a width larger than the length of one endcap unit.

It is also an object of the present invention to provide an endcap unit that can be used in conjunction with one or more endcap units, thereby facilitating replacement of damaged portions of an endcap in the field.

These and other objects of the present invention will become apparent after reading the specification in conjunction with the drawings.

SUMMARY OF INVENTION

The present invention is an endcap particularly adapted for use on a plurality of beams that form a rail car running board. These beams are typically beams having an I-shaped cross section formed by a vertical web portion and two transversely oriented flanges centered along the top and bottom edges of the vertical web portion. The beams are arranged and connected in parallel fashion to form the running board. Beams of this type can also be used to form a platform deck or running board of a vehicle, semi-trailer, marine vessel, or the like. The beams can also provide a platform for use as an industrial catwalk or any other platform application. The endcaps are advantageous in closing the ends of running boards constructed from fiberglass reinforced plastic beams, thereby complementing the strength, economy and durability of such materials. The endcaps provide a closure for the edges of the running board formed by the terminal ends of the beams, thereby protecting the beam ends from damage and providing safety to persons from the exposed beam ends of the edge of the running board.

Each endcap comprises a generally rectangular elongated base web portion having a plurality of paired transversely projecting flange fingers of a generally rectangular planar configuration. The paired flange fingers are vertically arranged along the length of the base web portion. The paired flange fingers are parallel to each other and form a gap therebetween. Each pair of flange fingers are spaced apart from other pairs to allow corresponding engagement with each end of spaced apart beams of a running board edge. When the endcap is installed, the flange fingers are positioned such that the gaps between each flange finger pair are aligned with the vertical web portion of each I-shaped beam. Each vertical web portion of each beam slides into the gap between each flange finger pair such that each flange finger of each pair is positioned on the outside surface of the vertical web portion of each beam. Each flange finger is thereby also vertically captured between the transverse flanges of the I-shaped beam. The bottom inside edges of the flange finger pairs are beveled. This creates a gap between the beveled surface and the surface formed by the intersection of the vertical web portion and the transverse flange of the I-shaped beams when the endcap is assembled to the beams. The gap creates space and provides a surface for adhesive to effectively bond the endcap to the beams. The endcap is formed of a resilient and durable material that enables bonding with a high performance, gap filling adhesive such as an epoxy.

In an alternate embodiment, the paired flange fingers are horizontally arranged along the length of the base web portion. The paired flange fingers are parallel to each other and form a gap therebetween. A second gap is created between each pair by the equally spaced arrangement along the length of the base web portion. In this configuration, this second gap aligns with and captures the vertical web portion of the beam.

The endcaps are designed for interlocking fit with each other. Each end of the endcap has a lip of reduced material thickness along its edge, thereby creating a bearing surface offset from the surface of the base web portion. The bearing surfaces of the lips on each end of the endcap are disposed on opposites sides of the base web portion. This allows the ends of two endcaps to correspondingly mate with each other. Each endcap is positioned such that the bearing surface of the lip on each endcap faces the other, thereby positioning the base web portions of each endcap such that they are flush. Therefore, more than one endcap may be installed on running boards having a larger dimension. This facilitates replacement of damaged portions of endcaps installed along the edge of a running board.

DESCRIPTION OF PREFERRED EMBODIMENT

Figure 1:
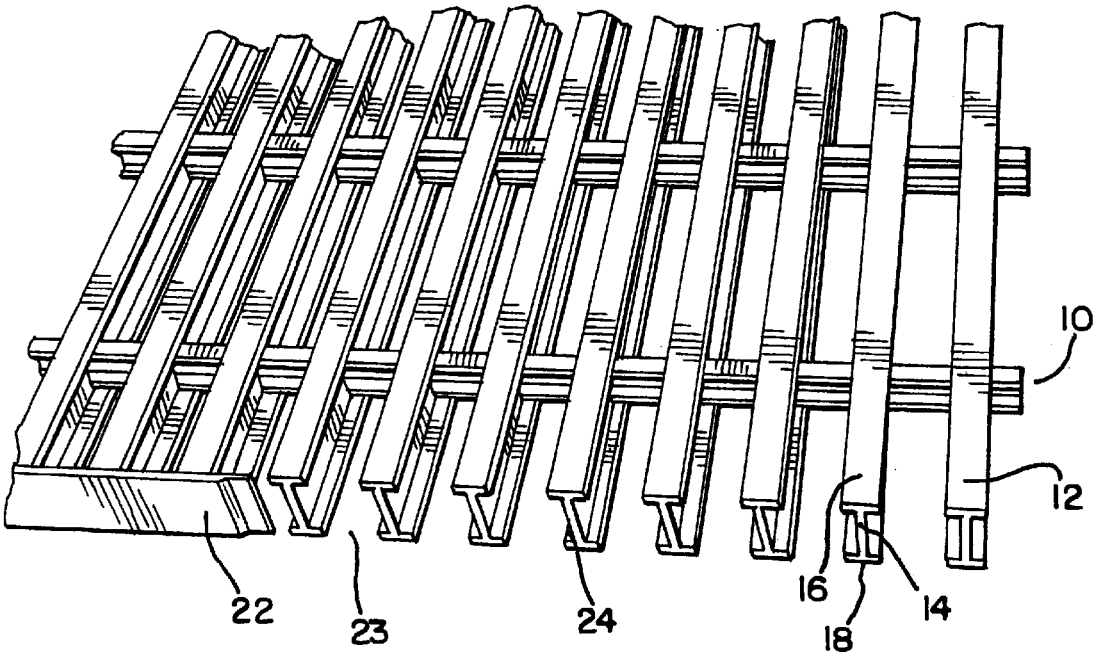
FIG. 1 is a perspective view of a running board having an endcap installed along an edge formed by terminating ends of parallel I-shaped beams.

A typical running board 10 is shown in FIG. 1. The running board 10 is constructed from a plurality of deck beams 12. The beams 12 are arranged and connected in parallel fashion to form the running board 10. The beams 12 are typically made of steel and have an I-shaped cross section formed by a vertical web portion 14, a transversely oriented top flange 16 centered along the top edge of the vertical web portion 14, and a transversely oriented bottom flange 18 centered along the bottom edge of the vertical web portion 14, as shown in FIG. 1. Typically, the running board 10 is used on railcars (not shown) in the railroad industry, but may also be used on other vehicles such as semi-trailers, ships, drilling platforms or may be in industrial applications such as catwalks in manufacturing or like applications. The I-beam configuration of the beams 12 has the load bearing and weight reducing advantages well known of I-beams, with the additional advantage of providing spacing between the beams 12 of the running board 10 to enable further weight reduction, minimize buildup of environmental precipitation, to enable washing, and the like.

Figure 2:
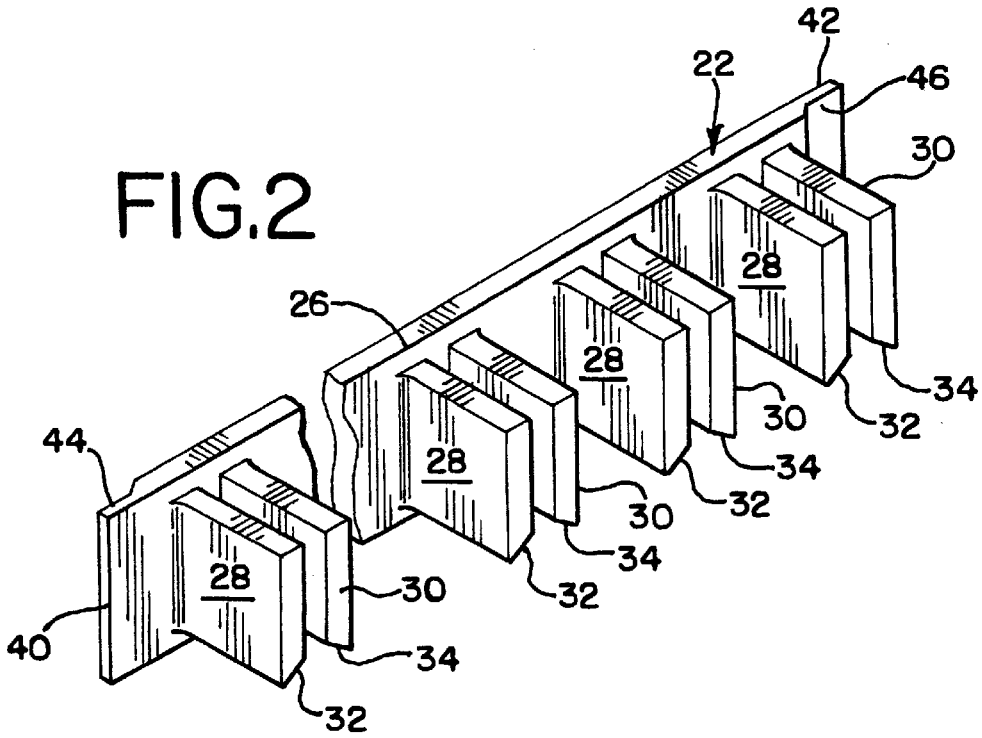
FIG. 2 is a perspective view of the running board endcap.

The present invention is an endcap 22, shown in FIG. 2. The endcap 22 provides a closure for an edge 23 of the running board 10 formed by terminal ends 24 of the beams 12, as shown in FIG. 1, thereby protecting the beam ends 24 from damage and providing safety to persons from the exposed beam ends 24 of the edge of the running board 10. Beam ends 24 are typically cut perpendicular to the length of the beams 12. Providing a closure to the edge 23 of the running board 10 is prudent in railroad service to minimize the chance of workers catching clothing on beam ends 24 and to minimize any injuries which could be sustained from contact with beam ends 24. There are also improved aerodynamics and a reduction in aerodynamic turbulence from a smooth surface. In a preferred embodiment, the endcap 22 is injection molded from outdoor grade PVC. However, other methods of manufacture and materials are also contemplated. For example, the endcap 22 may also be made of a cast metal material or molded from a reinforced nylon. The endcap 22 is designed to have a close tolerance fit with the beam ends 24. Therefore, methods of manufacture and materials that provide high tolerance stability are preferred.

Figure 3:
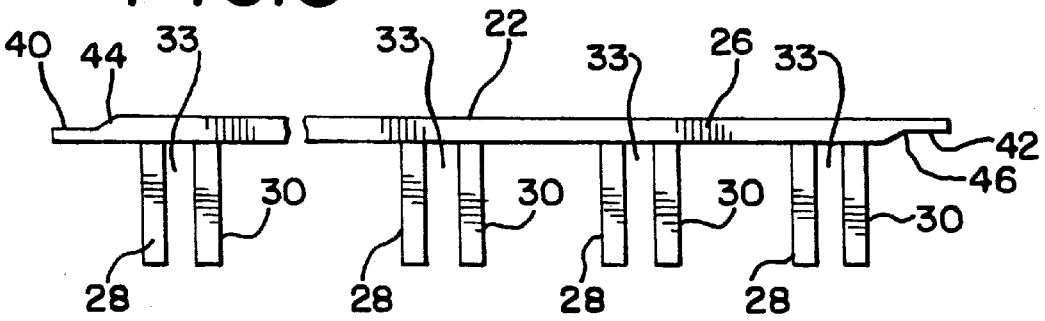
FIG. 3 is a top plan view of the running board endcap.
Figure 4A:
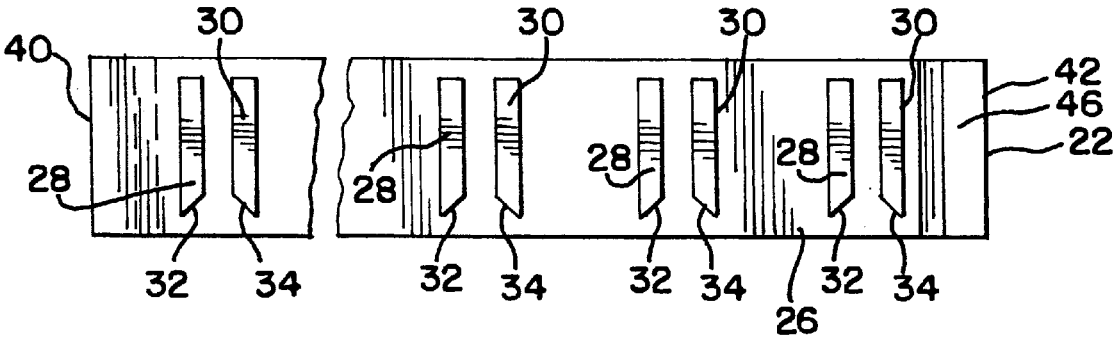
FIG. 4A is a front elevational view of the running board endcap.
Figure 4B:
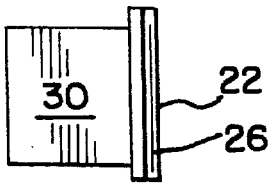
FIG. 4B is a side elevational view of the running board endcap.
Figure 5:
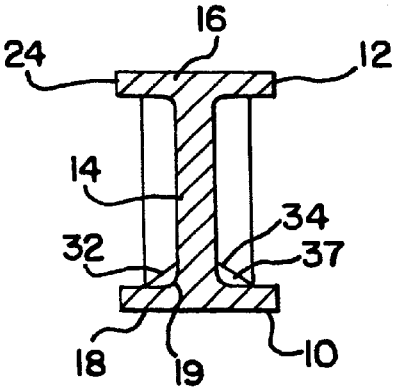
FIG. 5 is a sectional view of the running board endcap on a beam.
Figure 6:
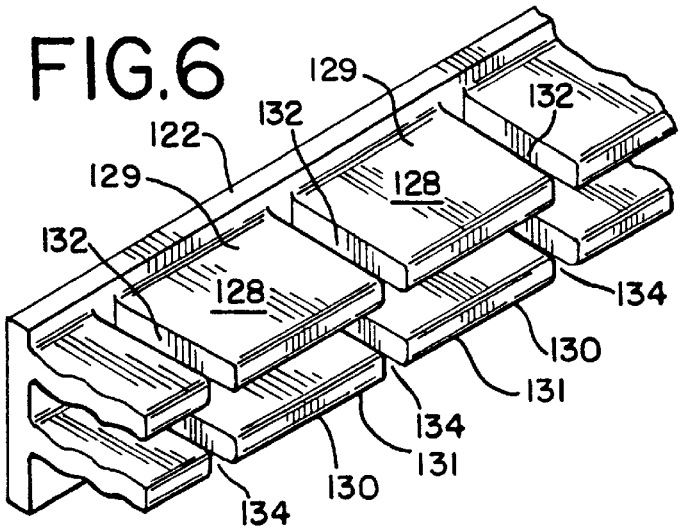
FIG. 6 is a perspective view of an alternate embodiment of the running board endcap.
Figure 7:
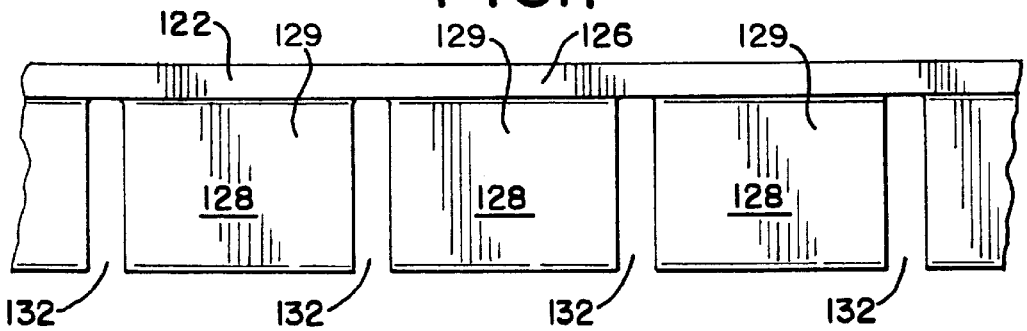
FIG. 7 is a top plan view of an alternate embodiment of the running board endcap.

The endcap 22 essentially comprises a generally rectangular base web portion 26 having a plurality of paired transversely projecting flange fingers 28 and 30, as shown in FIG. 2. The flange fingers 28 and 30 are of a generally rectangular planar configuration, as shown in FIG. 4B. The paired flange fingers 28 and 30 are parallel to each other and form a gap 33 therebetween, as shown in FIG. 3. Each pair of flange fingers 28 and 30 are disposed vertically along the length of the endcap 22 and are spaced apart from other pairs to allow corresponding engagement with each beam end 24 of spaced apart beams 12 forming the edge 23 of running board 10. FIGS. 3 and 4A show the spaced apart arrangement. When the endcap 22 is installed, the flange fingers 28 and 30 are positioned such that the gaps 33 between each flange finger pair 28 and 30 are aligned with the vertical web portion 14 of each I-shaped beam 12. Each vertical web portion 14 of each beam 12 slides into the gap 33 between each flange finger pair 28 and 30 such that each flange finger 28 and 30 is positioned on the side of the vertical web portion 14 of each beam 12 and substantially parallel to the vertical web portion 14, as shown in FIG. 5. Each flange finger 28 and 30 is thereby also vertically captured between the top transverse flange 16 and the bottom transverse flange 18 of the I-shaped beam 12.

Beveled surfaces 32 and 34 are disposed along the bottom of the flange fingers 28 and 30, respectively, as shown in FIG. 2. This creates a gap 37 between the beveled surfaces 32 and 34 and the fillet surface 19 formed by the intersection of the vertical web portion 14 and the bottom transverse flange 18 of the beams 12 when the endcap 22 is assembled to the beams 14, as shown in FIG. 5. The gap 37 creates space and provides a surface for adhesive to effectively bond the endcap 22 to the beams 14. The endcap 22 is formed of a resilient and durable material that enables bonding with a high performance, gap filling adhesive such as an epoxy. Weather, UV and chemically resistant material such as an outdoor Polyvinyl chloride (PVC) with pigments and UV stabilizer for this service is preferred. However, other thermoplastic materials, thermoset materials, and metallic materials are also usable.

The endcap 22 can be produced economically in typical plastic injection molded tooling. The endcap 22 is designed with the appropriate draft angles which, while facilitating removal of the molded plastic parts from the mold cavity, have additional benefits in placement in service. The tolerances of the mold design are held as close as possible to the nominal dimensions of the endcap 22 and specific tolerance stability properties of the PVC material are taken into account in order to insure that the dimensions of the endcap 22 are as stable as possible. Thus, the dimensions of the flange fingers 28 and 30 of the endcap 22 have very close tolerances to ensure proper fit and engagement with the beam ends 24 of the running board 10. Close tolerances also facilitate the use of a gap-filling resin, such as a thermosetting resin or epoxy, as an adhesive. Epoxy provides gap-filling as well as strong bonding. The slight draft angles of the flange fingers 28 and 30 will maximize bonding by preventing an excessively narrow gap which could result in an adhesively starved joint or an excessively wide gap which would insufficiently bond. In an alternate embodiment, the endcap 22 is designed to enable a compression fit with the beam ends 14 utilizing the dimensional and resilient properties of the PVC (or other similar material) from which the endcaps 22 are formed. Thus, a compression fit could be provided in the above described mounting. However, adhesive bonding is the preferred method of mounting.

The endcap 22 is of a modular design allowing for an interlocking fit with other endcaps of the same design. Each endcap 22 has a lip 40 and 42 of reduced material thickness along its shorter edges, thereby creating bearing surfaces 44 and 46 offset from the surface of the base web portion 26, as shown in FIG. 2. The bearing surfaces 44 and 46 of the lips 40 and 42 on each end of the endcap 22 are disposed on opposites sides of the base web portion 26, thereby providing complementary recesses for adjacent endcaps 22. This allows the ends of two endcaps 22 to correspondingly overlap and mate with each other. Each endcap 22 is positioned such that the bearing surfaces 46 of the lip 42 on each endcap 22 faces the bearing surface 44 of the lip 40 of the other endcap 22, thereby positioning the base web portions 26 of each endcap 22 such that they are co-planar and flush with each other. Therefore, more than one endcap 22 may be installed along the edge 23 of running boards 10 having extra length. This modular design facilitates easy replacement of damaged portions of endcaps 22 installed along the edge 23 of the running board 10. The modular design also enables greater economy in inventory and flexibility in field application.

Figure 8A:
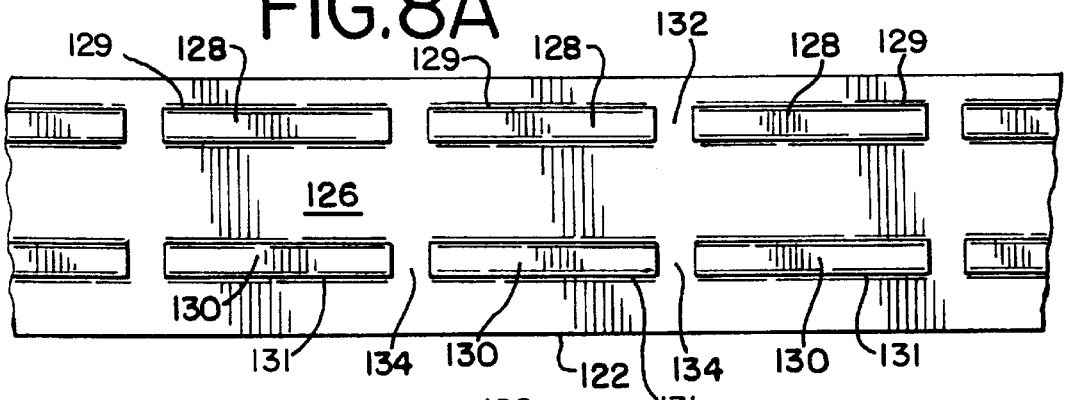
FIG. 8A is a front elevational view of an alternate embodiment of the running board endcap.
Figure 8B:
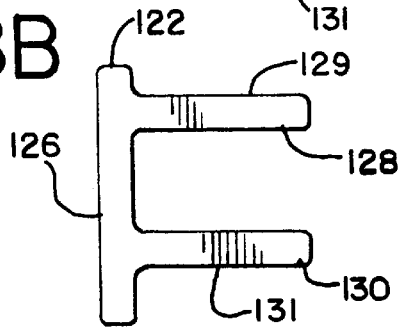
FIG. 8B is a side elevational view of an alternate embodiment of the running board endcap.

An alternate configuration of the present invention is shown in FIGS. 6–8B. An endcap 122 is formed of a web portion 126 having transversely projecting paired flange fingers 128 and 130, as shown in FIGS. 8A and 8B. The flange fingers 128 and 130 are of a generally rectangular planar configuration. In this configuration, the flange fingers 128 and 130 are disposed horizontally along the length of the endcap 122. Gaps 132, 134 are provided between each horizontal pair of flange fingers 128 and 130. When the endcap 122 is installed, the gaps 132 between each pair of flange fingers 128 and 130 are aligned with the vertical web portion 14 of each I-shaped beam 12. Each vertical web portion 14 of each beam 12 slides into the gap 132 between each pair of flange fingers 128 and 130 such that each flange finger 128 and 130 is positioned on the side of the vertical web portion 14 of each beam 12 and transverse to the vertical web portion 14. In this configuration, the outside surfaces 129 and 131 of the flange fingers 128 and 130 are captured between the top transverse flange 16 and the bottom transverse flange 18 of the I-shaped beam 12. The gaps 132 may be molded into the flange fingers 128 and 130 of the endcap 122, or they may be cut or machined. A major advantage to this alternate configuration is that it can be extruded rather than molded. The economy of continuous extruding can offset the cost of the machining operation in forming the gaps 132. However, the endcap 122 could also be formed by pultrusion, similar to the formation of the beams 12. The endcap 122 is formed of a resilient and durable material that enables bonding with a high performance, gap filling adhesive such as an epoxy. Weather, UV and chemically resistant material such as an outdoor Polyvinyl chloride (PVC) is preferred. However, other thermoplastic materials, thermoset materials, and metallic materials are also anticipated.

While specific embodiments of the present invention have been shown here for the purposes of explaining preferred and alternate embodiments of the invention, it is to be understood that the appended claims have a wide range of equivalents and a broader scope than the embodiments disclosed.

What is claimed is:

1. An endcap for enclosing an edge formed by a plurality of terminal ends of I-shaped beams having vertical web portions, the endcap comprising:

a base web portion;

a plurality of paired flange fingers transversely projecting from the web portion, the paired flange fingers forming a gap therebetween, the pairs of flange fingers equally spaced apart on the base web portion to correspondingly align the gap with the vertical web portions of the I-shaped beams, the gaps of the flange finger pairs capable of accepting the correspondingly aligned vertical web portions of the I-shaped beams, wherein the base web portion is of a generally flat shape having a minor axis and a major axis, the pairs of flange fingers disposed parallel to the minor axis of the base web portion, and wherein the paired transversely projecting flange fingers are of a generally flat shape defining an outer surface, an inner gap surface, a top edge surface and a bottom edge surface.

2. The endcap of claim 1, wherein the flange fingers are of a generally rectangular shape.

3. The endcap of claim 2, wherein the bottom edge surface of the flange fingers is a beveled surface sloping upwardly and inwardly toward the gap between the paired flange fingers.

4. The endcap of claim 3, wherein the endcap is made of polyvinyl chloride.

5. An endcap for enclosing an edge formed by a plurality of terminal ends of I-shaped beams having vertical web portions, the endcap comprising:

a generally flat and elongated base web portion having generally short side edges, longer top and bottom edges, a front surface and a back surface, each short side edge having a lip of reduced material thickness thereby providing an offset bearing surface, one bearing surface disposed on the front surface of the base web portion and the other bearing surface disposed on the back surface of the base web portion, the lips of the short side edges of the base web portion allowing mating and alignment of the endcap with other adjacent endcaps; and a plurality of generally flat paired flange fingers transversely projecting from the web portion and forming a gap therebetween, the pairs of flange fingers equally spaced apart on the base web portion to correspondingly align the gap with the vertical web portions of the I-shaped beams, the gaps of the flange finger pairs capable of accepting the correspondingly aligned vertical web portions of the I-shaped beams.

6. The endcap of claim 5, wherein the base web portion and the flange fingers are rectangular in shape.

7. The endcap of claim 5, wherein the endcap is made of polyvinyl chloride.

8. The endcap of claim 5, wherein said fingers have surfaces which form said gap so as to converge toward the base web whereby said gap has compression fit with said I-beams at the base of the fingers, while an adhesive fillable space is provided at the end of said fingers.

9. An endcap for enclosing an edge formed by a plurality of terminal ends of I-shaped beams having vertical web portions, the endcap comprising:

a generally flat and elongated base web portion having generally short side edges and longer top and bottom edges; and a plurality of generally flat paired flange fingers transversely projecting from the web portion and parallel to the longer top and bottom edges of the base web portion, the flange fingers forming a first gap therebetween, the pairs of flange fingers equally spaced apart on the base web portion and forming a second gap between each pair of flange fingers, the second gap transverse to the first gap, the pairs of flange fingers spaced apart to correspondingly align the second gap with the vertical web portions of the I-shaped beams, the second gap capable of accepting the correspondingly aligned vertical web portions of the I-shaped beams.

10. The endcap of claim 9, wherein the base web portion has a front surface and a back surface, each short side edge of the base web portion having a lip of reduced material thickness thereby providing an offset bearing surface, one bearing surface disposed on the front surface of the base web portion and the other bearing surface disposed on the back surface of the base web portion, the lips of the short side edges of the base web portion allowing mating and alignment of the endcap with other adjacent endcaps.

11. The endcap of claim 9, wherein the endcap is formed by extrusion and the second gaps are cut therein.

12. The endcap of claim 9, wherein the endcap is formed by pultrusion and the second gaps are cut therein.

* * * * *